US011136907B1

(12) United States Patent
Patrick

(10) Patent No.: US 11,136,907 B1
(45) Date of Patent: Oct. 5, 2021

(54) HYDRAULIC LIFTER WITH CARTRIDGE STYLE ADJUSTMENT INSERT SUB-ASSEMBLY

(71) Applicant: Competition Cams, Inc., Memphis, TN (US)

(72) Inventor: Matthew Patrick, Germantown, TN (US)

(73) Assignee: Competition Cams, Inc., Memphis, TN (US)

( * ) Notice: Subject to any disclaimer, the term of this patent is extended or adjusted under 35 U.S.C. 154(b) by 0 days.

(21) Appl. No.: 17/152,560

(22) Filed: Jan. 19, 2021

Related U.S. Application Data

(60) Provisional application No. 62/991,713, filed on Mar. 19, 2020, provisional application No. 62/963,457, filed on Jan. 20, 2020.

(51) Int. Cl.

| | |
|---|---|
| ***F01L 1/24*** | (2006.01) |
| ***F01L 1/46*** | (2006.01) |
| ***F01L 1/14*** | (2006.01) |
| *F01L 1/245* | (2006.01) |

(52) U.S. Cl.
CPC ..... *F01L 1/24* (2013.01); *F01L 1/146* (2013.01); *F01L 1/46* (2013.01); *F01L 2001/2427* (2013.01); *F01L 2001/2433* (2013.01); *F01L 2001/2444* (2013.01); *F01L 2001/256* (2013.01)

(58) Field of Classification Search
CPC ..... F01L 2001/2427; F01L 2001/2433; F01L 2001/256
USPC ..... 123/90.58
See application file for complete search history.

(56) References Cited

U.S. PATENT DOCUMENTS 4,191,142 A * 3/1980 Kodama ..... F01L 1/245 123/90.58

* cited by examiner

*Primary Examiner* — Jorge L Leon, Jr.
(74) *Attorney, Agent, or Firm* — Edwin A. Sisson, Attorney at Law, LLC; Jeffrey J. Banyas

(57) ABSTRACT

It is described herein a hydraulic lifter for an internal combustion engine. The hydraulic lifter may comprise a lifter body, a self-contained hydraulic cartridge, a pushrod seat, and a retaining clip. The self-contained hydraulic cartridge may be disposed within a cartridge bore in the lifter body. The self-contained hydraulic cartridge may comprise a self-contained hydraulic system such that a lifter piston of the hydraulic system is not directly disposed within a bore in the lifter body.

20 Claims, 12 Drawing Sheets

HYDRAULIC LIFTER WITH CARTRIDGE STYLE ADJUSTMENT INSERT SUB-ASSEMBLY

CROSS REFERENCES AND PRIORITIES

This Application claims priority from U.S. Provisional Application No. 62/963,457 filed on 20 Jan. 2020 and U.S. Provisional Application No. 62/991,713 filed on 19 Mar. 2020, the teachings of each of which are incorporated by reference herein in their entirety.

BACKGROUND

Internal combustion engines utilize lifters, also known as tappets, to actuate intake and exhaust valves. In conventional pushrod engines, one end of the lifter rests against a lobe of the engine's camshaft while the opposite end of the lifter rests against an end of the pushrod. As the cam rotates, the lifter advances and retracts within a lifter bore causing the pushrod to act upon one end of a rocker arm causing the other end of the rocker arm to act upon the valve tip to open and close the respective valve.

Conventional lifters of a solid design require regular adjusting to maintain a small clearance, also known as valve lash, between the valve tip and the rocker arm. This valve lash prevents binding between the various components of the engine's valve train during operation allowing the valve to completely close, but also leads to increased wear and engine noise.

Hydraulic lifters reduce or eliminate the issues caused by conventional lifters by eliminating the need for valve lash and valve lash adjustments. Hydraulic lifters known in the art are comprised of a hollow steel cylinder—also known as a lifter body—encasing an internal lifter piston. In practice, the lifter body will contain at least two bores formed directly into the lifter body with one bore forming a high pressure chamber and a second bore forming a low pressure chamber.

In combination with the internal lifter piston, the high pressure chamber and low pressure chamber form a hydraulic system which is supplied with oil from within the engine through a small hole or inlet in the lifter body. When the engine valve is closed, oil enters the low pressure chamber of the hydraulic system. During this time, the oil in the low pressure chamber may enter the high pressure chamber through a check valve separating the two chambers. As the camshaft rotates to open the engine valve, the lifter piston is compressed by the camshaft lobe. Simultaneously, the check valve between the high pressure chamber and the low pressure chamber will shut due to the pressure differential between the high pressure chamber and the low pressure chamber. The pressure formed by the near incompressible oil renders the lifter "solid" during this lift phase of the camshaft rotation. However, the lifter piston will move a small amount—also known as "bleed down"—during the lift phase of the camshaft rotation.

As the camshaft continues to rotate to return the engine valve to the closed position, the load is reduced on the lifter piston and a spring returns the lifter piston to its "neutral" state. When the lifter piston is returned to its neutral state, the check valve separating the low pressure chamber and the high pressure chamber opens allowing oil to exit the high pressure chamber and enter the low pressure chamber. Simultaneously, a small amount of oil is released from the hydraulic system to allow the hydraulic system to re-adjust pressure and maintain a consistent length. The range—or stroke—of the lifter piston, while small, allows for sufficient movement to eliminate the need for lash adjustment.

In practice, current hydraulic lifters suffer from many problems related to the bores for the lifter piston being formed directly into the lifter body. Distortion of the lifter body can distort the bore, leading to sticking lifter pistons, altered "bleed down" rates, or outright failure of the hydraulic lifter. Additionally, hydraulic systems requiring precision pressures and bleed down rates for differing applications are not interchangeable. This results in the need for replacing the entire hydraulic lifter in order to adjust the hydraulic profile. Also, rebuilding or repairing the hydraulic system—without replacing the entire hydraulic lifter itself—becomes difficult or impossible.

The need exists, therefore, for an improved hydraulic lifter which is less susceptible to the effects of lifter body distortion, and which allows for adjustment, rebuilding, and/or repair of the hydraulic system without the need for replacing the entire hydraulic lifter itself.

SUMMARY

A hydraulic lifter for an internal combustion engine is disclosed. The hydraulic lifter may comprise a lifter body, a self-contained hydraulic cartridge, a pushrod seat, and a retaining clip. The lifter body may comprise a hydraulic cartridge bore, and a first radial oil passage disposed through a lifter body sidewall.

The self-contained hydraulic cartridge and the pushrod seat may be contained within the hydraulic cartridge bore. A pushrod seat second end may abut against a self-contained hydraulic cartridge first end. The retaining clip may be located within a groove disposed in a sidewall of the hydraulic cartridge bore at a lifter body first end. A pushrod seat first end which is opposite of the pushrod seat second end may abut against the retaining clip.

In some embodiments, the hydraulic lifter may further comprise a roller connected to the lifter body at a lifter body second end which is opposite of the lifter body first end. In certain embodiments, the roller may be connected to the lifter body by an axle. In other embodiments, the hydraulic lifter may not comprise a roller connected to the lifter body at a lifter body second end which is opposite of a lifter body first end.

In some embodiments, the pushrod seat may comprise a first axial oil passage.

In some embodiments, the self-contained hydraulic cartridge may comprise a cartridge body, a ball plunger, a lifter piston, a check valve, and a plunger spring.

When present in such embodiments, the cartridge body may comprise a high pressure chamber, a bore originating from a cartridge body first end, a cartridge body sidewall having a circumferential recess, and a second radial oil passage disposed into the cartridge body sidewall.

When present in such embodiments, the ball plunger may comprise a low pressure chamber, and a third radial oil passage to the low pressure chamber disposed into a ball plunger sidewall. In some embodiments, the ball plunger may be disposed within the bore. In certain embodiments, a portion of the ball plunger may extend from the cartridge body first end.

When present in such embodiments, the lifter piston may separate the high pressure chamber from the low pressure chamber.

When present in such embodiments, the check valve may be disposed between the lifter piston and the high pressure chamber.

When present in such embodiments, the plunger spring may be within the high pressure chamber.

In some such embodiments, the ball plunger may comprise a second axial oil passage.

In certain embodiments, the self-contained hydraulic cartridge may comprise a cartridge body, a lifter piston, a check valve, and a plunger spring.

When present in such embodiments, the cartridge body may comprise a high pressure chamber, a bore originating from a cartridge body first end, a cartridge body sidewall, a second radial oil passage disposed into the cartridge body sidewall, and a circumferential groove disposed in the bore proximate the cartridge body first end.

When present in such embodiments, the lifter piston may comprise an axial hole forming a portion of a low pressure chamber, and a third radial oil passage to the low pressure chamber disposed into a lifter piston sidewall.

When present in such embodiments, the check valve may be disposed between the lifter piston and the high pressure chamber.

When present in such embodiments, the plunger spring may be within the high pressure chamber.

The pushrod seat in such embodiments may be located within a portion of the axial hole, with a portion of a pushrod seat first end abutting against a pushrod seat clip disposed within the circumferential groove.

In some such embodiments, the lifter piston may further comprise a piston circumferential recess.

In certain such embodiments, the pushrod seat may comprise a seat circumferential recess. In some such embodiments, a sidewall of the lifter piston may interact with the circumferential recess of the pushrod seat.

Some such embodiments may further comprise a metering disk located within the axial hole beneath the pushrod seat.

In certain embodiments, the check valve may be a ball check valve. In some embodiments, the check valve may be a disc check valve.

In some embodiments, the check valve may comprise a check valve spring.

DETAILED DESCRIPTION

This invention is to a hydraulic lifter for an internal combustion engine. Reference will now be made to the various Figures in which, unless otherwise noted, like numbers refer to like structures. As described herein and in the claims, the following numbers refer to the following structures as noted in the Figures.

1 refers to a prior art hydraulic lifter.
2 refers to a lifter body (of the prior art hydraulic lifter).
3 refers to a lifter piston (of the prior art hydraulic lifter).
4 refers to a check valve (of the prior art hydraulic lifter).
5 refers to a low pressure chamber (of the prior art hydraulic lifter).
6 refers to a high pressure chamber (of the prior art hydraulic lifter).
7 refers to a pushrod seat (of the prior art hydraulic lifter).
8 refers to a retaining clip (of the prior art hydraulic lifter).
9A refers to a hole (in the sidewall of the prior art hydraulic lifter).
9B refers to a hole (in the sidewall of the lifter piston of the prior art hydraulic lifter).
10 refers to a hydraulic lifter.
100 refers to a lifter body.
101 refers to a lifter body first end.
102 refers to a lifter body second end.
110 refers to a hydraulic cartridge bore.
115 refers to a groove.
120 refers to a first radial oil passage.
200 refers to a self-contained hydraulic cartridge.
201 refers to a self-contained hydraulic cartridge first end.
202 refers to a self-contained hydraulic cartridge second end.
210 refers to a cartridge body.
211 refers to a cartridge body first end.
212 refers to a high pressure chamber.
213 refers to a circumferential groove.
214 refers to a second radial oil passage.
216 refers to a circumferential recess.
218 refers to a bore (in the cartridge body).
220 refers to a ball plunger.
221 refers to a ball plunger first end.
222 refers to a low pressure chamber.
223 refers to a ball plunger second end.
224 refers to a third radial oil passage.
226 refers to a second axial oil passage.
228 refers to a first convex surface.
230 refers to a lifter piston.
232 refers to an axial hole.
234 refers to a piston circumferential recess.
240 refers to a check valve.
242 refers to a relief bore.
250 refers to a plunger spring.
260 refers to a metering disk.
300 refers to a pushrod seat.
301 refers to a pushrod seat first end.
302 refers to a pushrod seat second end
310 refers to a first axial oil passage.
320 refers to a first concave surface.
330 refers to a second concave surface.
340 refers to a pushrod seat clip.
350 refers to a seat circumferential recess.
400 refers to a retaining clip.
500 refers to a roller.

510 refers to an axle.
600 refers to a valvetrain.
610 refers to a camshaft.
615 refers to a camshaft lobe.
620 refers to a pushrod.
630 refers to a rocker arm.
640 refers to a rocker arm mounting stud.
645 refers to a rocker arm mounting nut.
650 refers to a valve.
652 refers to a valve spring.
654 refers to a valve spring retainer.

Figure 1:
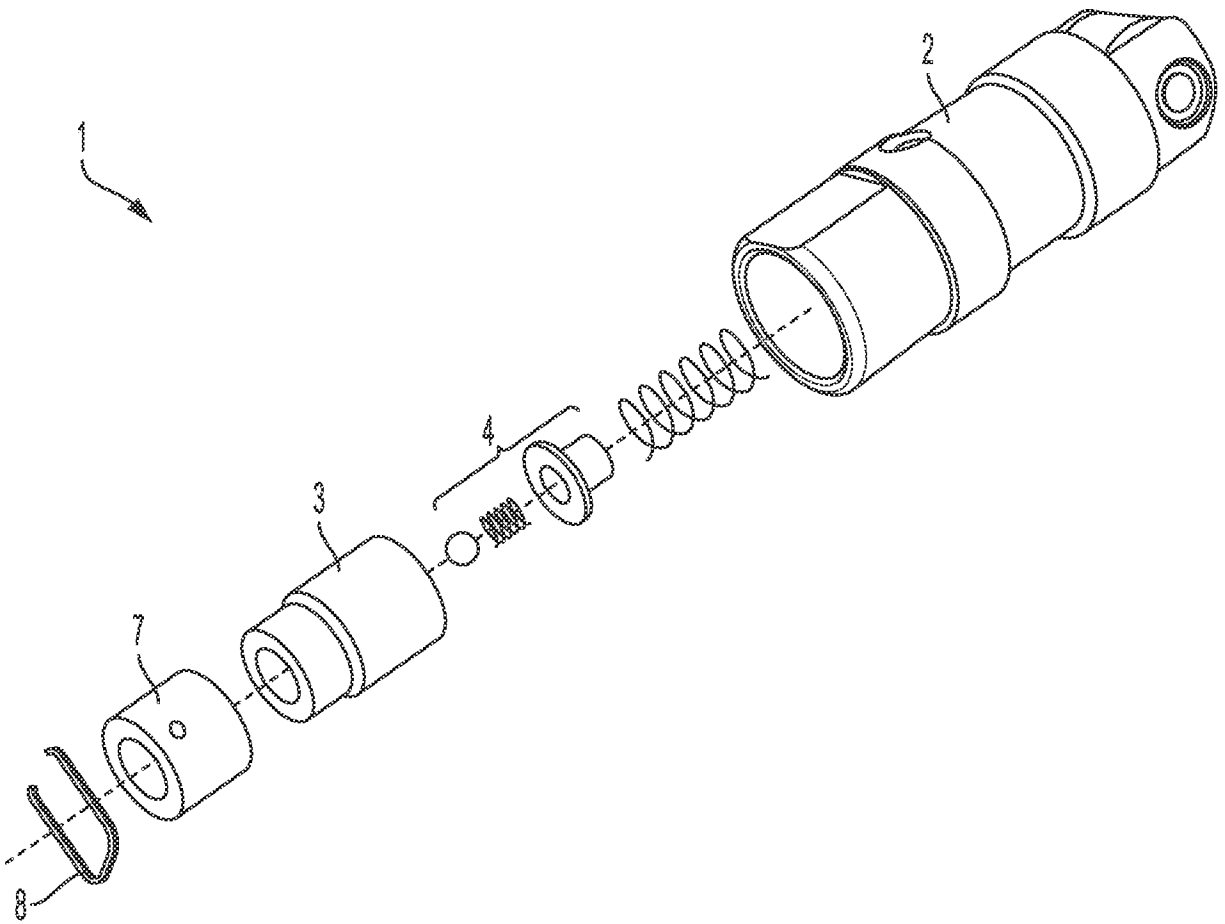
FIG. 1 PRIOR ART
FIG. 1 is an exploded perspective view of a prior art hydraulic lifter.

FIG. 1 depicts an exploded perspective view of a prior art hydraulic lifter (1) for an internal combustion engine. As shown in FIG. 1, the prior art hydraulic lifter comprises a lifter body (2), a lifter piston (3), a check valve (4), a pushrod seat (7), and a retaining clip (8).

Figure 2:
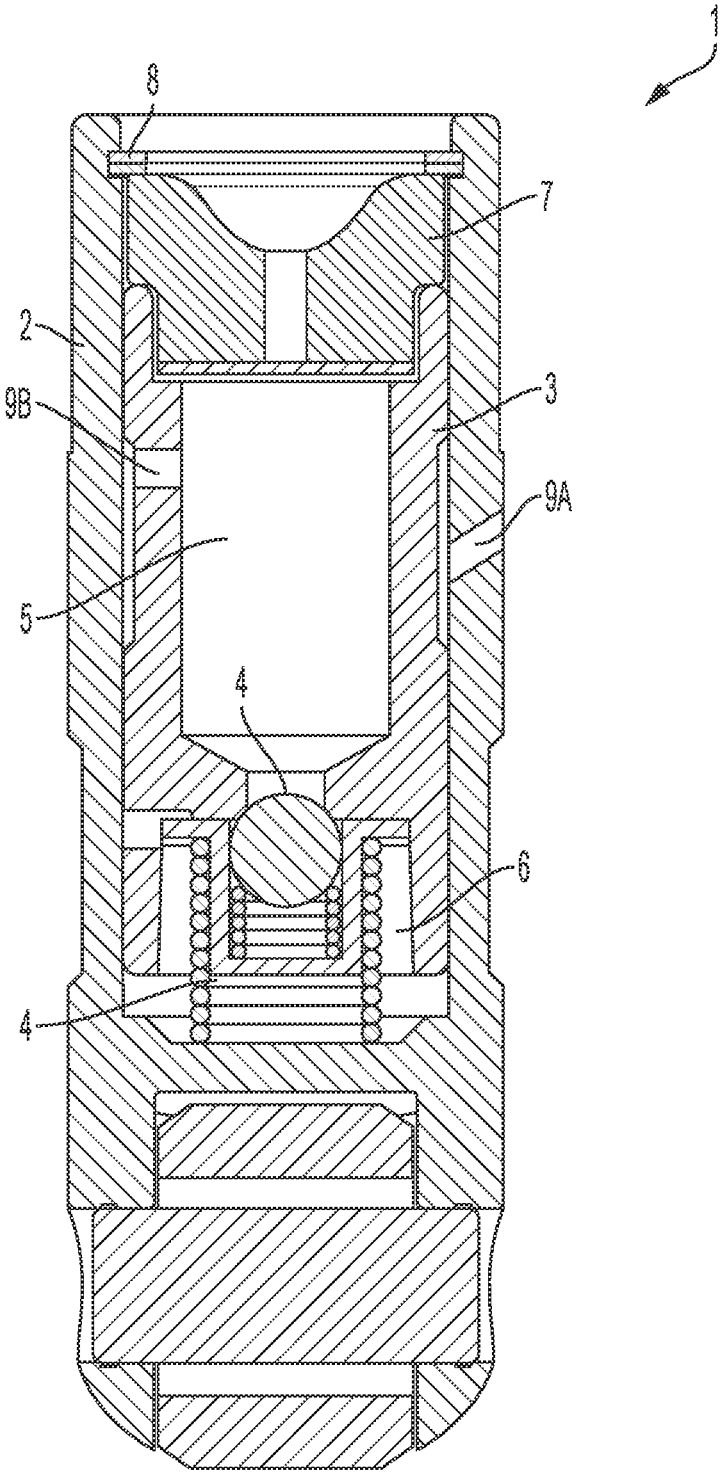
FIG. 2 PRIOR ART
FIG. 2 is a fully assembled cross section view of a prior art hydraulic lifter.

FIG. 2 depicts an assembled cross section view of the prior art hydraulic lifter (1) for an internal combustion engine shown in FIG. 1. As shown in FIG. 2, once assembled, the lifter piston (3) rests within a bore (also known as an internal cavity) in the lifter body (2). The check valve is located beneath the lifter piston within the bore in the lifter body, and separates the bore into a low pressure chamber (5) and a high pressure chamber (6). The high pressure chamber is formed—in part—by the end wall surface of the bore within the lifter body. The pushrod seat (7) is located above the lifter piston within the bore in the lifter body. The retaining clip (8)—which prevents the pushrod seat, the lifter piston, and the check valve from exiting the bore in the lifter body—is then disposed within a groove in the bore above the pushrod seat.

In use, engine oil passes into a circumferential recess in the bore in the lifter body of the prior art hydraulic lifter through a hole (9A) in a sidewall of the lifter body. The engine oil then passes into the low pressure chamber (5) through a hole (9B) in a sidewall of the lifter piston with the check valve allowing the engine oil to pass from the low pressure chamber into the high pressure chamber (6). During this "lift phase", the nearly incompressible engine oil renders the lifter "solid". As the camshaft continues to turn, and the valve returns to the closed position, the pressure is reduced, and the lifter piston returns to its previous "neutral" state. Simultaneously, a small amount of oil is released from the hydraulic system through the holes sidewall of the lifter piston and the sidewall of the lifter body to allow the hydraulic system to readjust pressure and maintain a constant length.

As shown in FIG. 2, in the prior art hydraulic lifter (1), the lifter piston (3) is disposed directly within the bore of the lifter body (2). Accordingly, any distortion in the lifter body affects the hydraulic performance of the entire hydraulic system.

Figure 3:
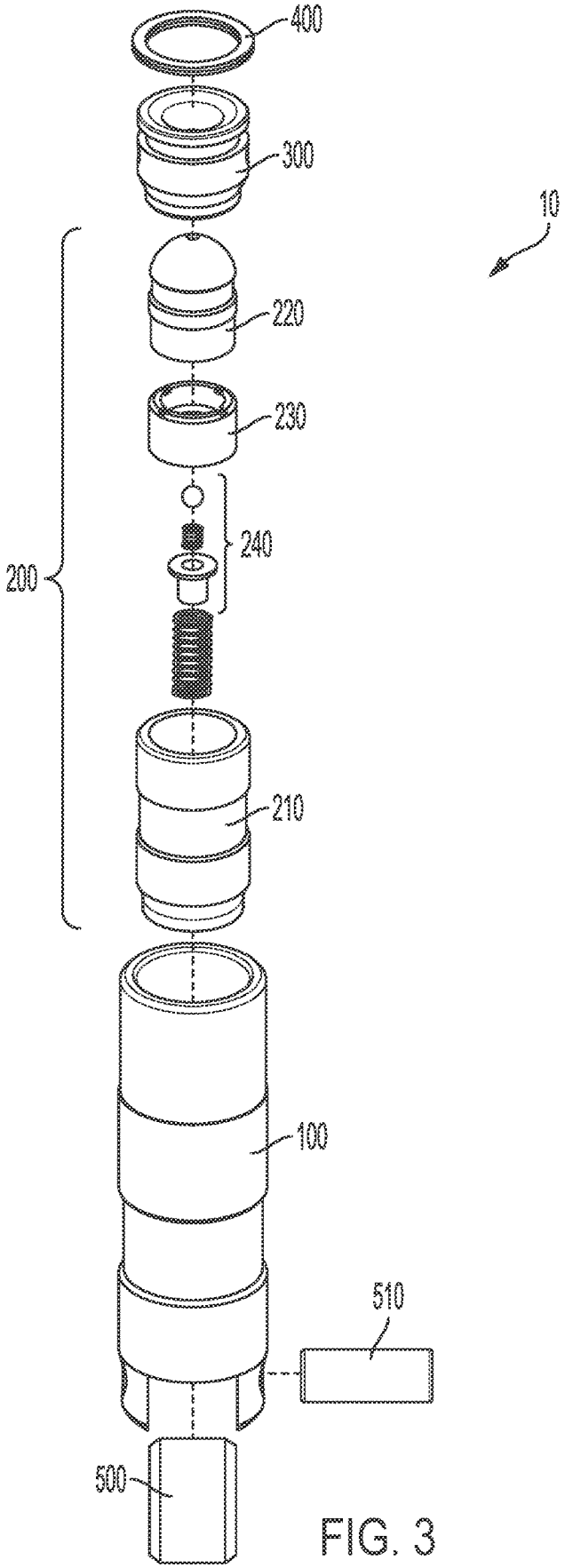
FIG. 3 is a fully exploded perspective view of one embodiment of an invented hydraulic lifter.

FIG. 3 depicts a fully exploded perspective view of an embodiment of an invented hydraulic lifter (10). As shown in FIG. 3, embodiments of the invented hydraulic lifter may comprise a lifter body (100), a self-contained hydraulic cartridge (200), a pushrod seat (300), and a retaining clip (400).

FIG. 3 also shows the components of one embodiment of a self-contained hydraulic cartridge. As used herein and in the claims, "self-contained" means that the hydraulic system does not utilize a surface of the lifter body or the bore in the lifter body to form any part of the high pressure chamber or the low pressure chamber. "Self-contained" does not necessarily mean that engine oil or other fluids from outside of the lifter body are prevented from entering the internal components of the hydraulic cartridge (i.e.—the low pressure chamber and the high pressure chamber). In fact, the embodiments disclosed herein and shown in the Figures utilize engine oil passing through a radial hole in a sidewall of the lifter body and a corresponding radial hole in a sidewall of the cartridge body as the hydraulic fluid for the self-contained hydraulic cartridge.

Figure 5:
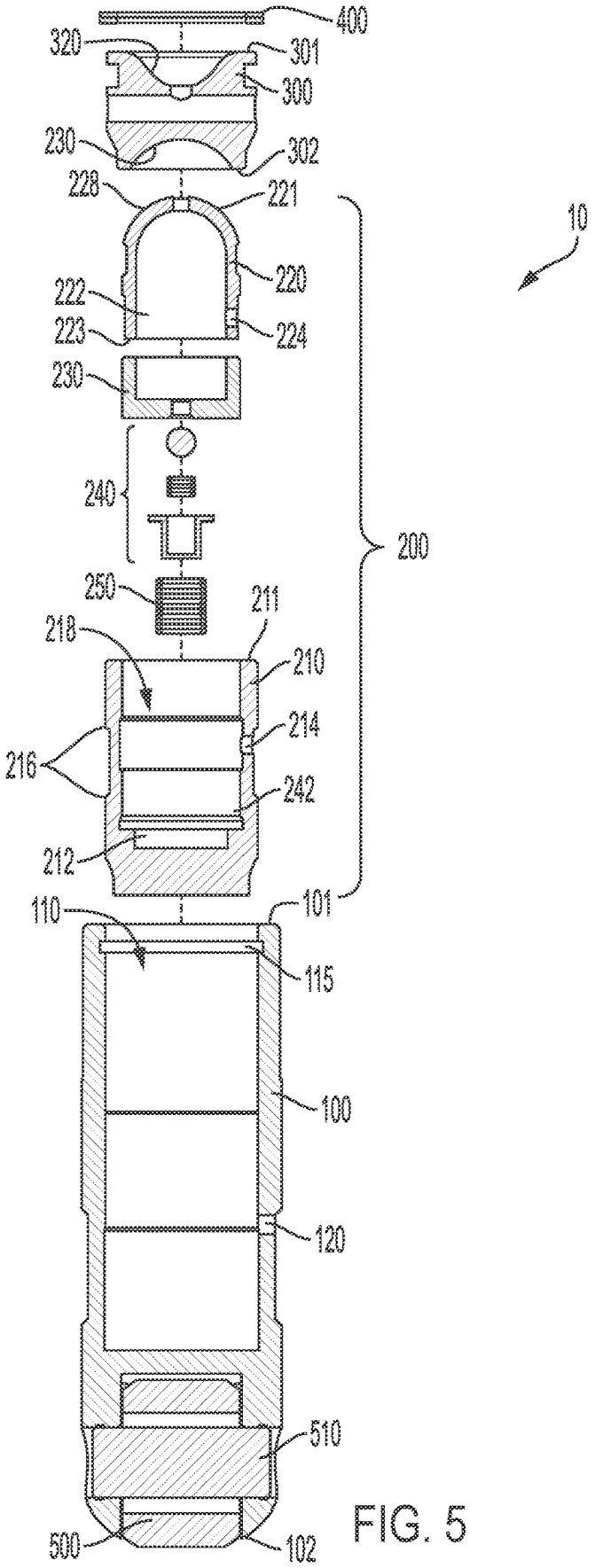
FIG. 5 is a fully exploded cross section view of one embodiment of an invented hydraulic lifter.

As shown in FIG. 3, one embodiment of a self-contained hydraulic cartridge may comprise a cartridge body (210), a ball plunger (220), a lifter piston (230), a check valve (240), and a retainer (242 as shown in FIG. 5). While the Figures show the hydraulic cartridge comprising the cartridge body (210), ball plunger (220), lifter piston (230), check valve (240), and retainer (242)—other configurations of a self-contained hydraulic cartridge may exist.

Figure 4:
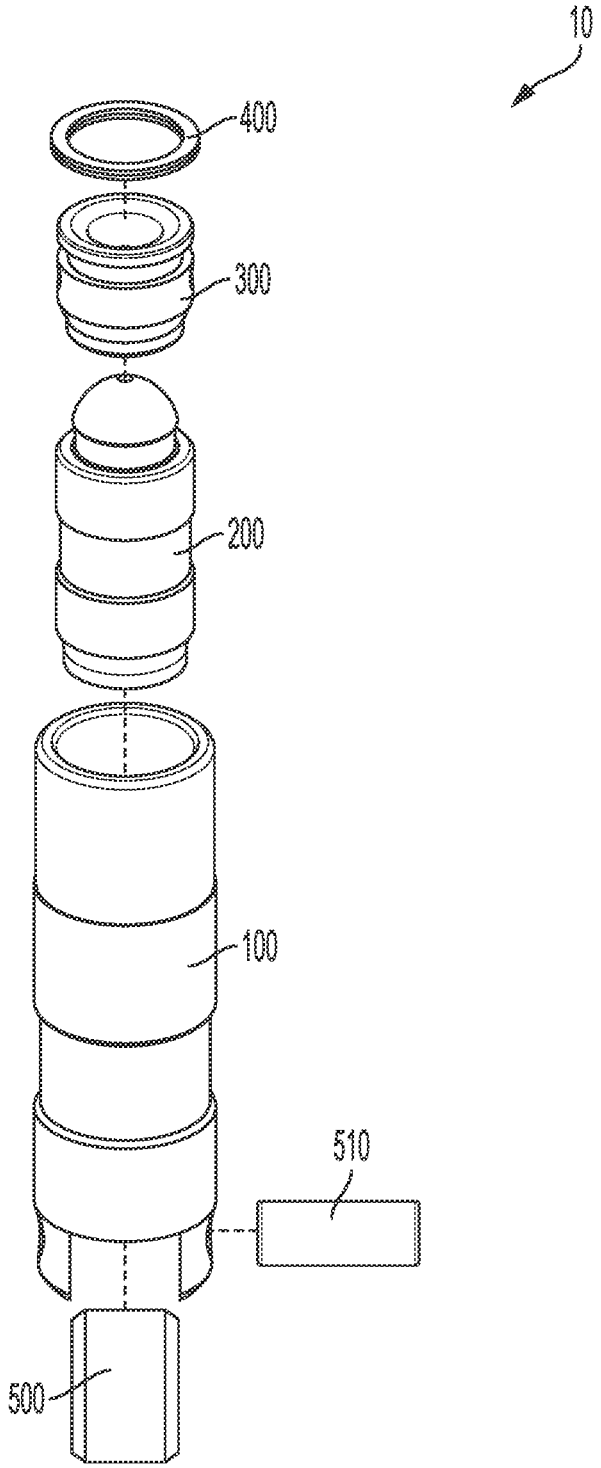
FIG. 4 is a partially exploded perspective view of one embodiment of an invented hydraulic lifter.

FIG. 4 shows a partially assembled perspective view of an embodiment of an invented hydraulic lifter (10). FIG. 4 shows the various components of the self-contained hydraulic cartridge from FIG. 3 (200) assembled into a complete self-contained hydraulic cartridge.

FIG. 5 shows a fully exploded cross section view of the embodiment of an invented hydraulic lifter (10) shown in FIG. 3. As shown in FIG. 5, the lifter body (100) comprises a lifter body first end (101), a lifter body second end (102) opposite the lifter body first end, and a hydraulic cartridge bore (110). The hydraulic cartridge bore may be thought of as a blind hole originating from the lifter body first end and extending towards the lifter body second end. When assembled, the self-contained hydraulic cartridge (200) and the pushrod seat (300) are each contained within the hydraulic cartridge bore.

The hydraulic cartridge bore (110) may also comprise a groove (115) disposed in a sidewall of the hydraulic cartridge bore at the lifter body first end (101). When assembled, the retaining clip (400) is located within the groove to retain the pushrod seat (300) and the self-contained hydraulic cartridge (100) within the hydraulic cartridge bore.

FIG. 5 further shows the pushrod seat (300). As shown in FIG. 5, the pushrod seat may have a first concave surface (320) located at a pushrod seat first end (301). The pushrod seat may also have a second concave surface (330) located at a pushrod seat second end (302) which is opposite the pushrod seat first end.

FIG. 5 also shows the lifter body (100) comprising a first radial oil passage (120). As used herein and in the claims, the term "radial oil passage" refers to a hole passing through a sidewall of a substantially cylindrical component of the lifter in a generally radial direction. While a central axis of the radial oil passage may be substantially parallel with or parallel with the radius of the substantially cylindrical component, it is not required that the central axis be parallel with the radius of the substantially cylindrical component. In some embodiments, a central axis of the radial oil passage may form an angle with the radius of the substantially cylindrical component which is in a range selected from the group consisting of between 0° and 89°, between 0° and 60°, between 0° and 45°, between 0° and 30°, and between 0° and 15°.

As shown in FIG. 5, the first radial oil passage (120) is disposed into the lifter body sidewall. This first radial oil passage allows engine oil from outside of the lifter body to enter the hydraulic cartridge bore (110). In the embodiments shown, the first radial oil passage is located at a distance from the lifter body first end (101) corresponding to a location of a circumferential recess (216) in a sidewall of the cartridge body such that the engine oil can flow around the cartridge body and enter the self-contained hydraulic cartridge through a second radial oil passage (214) which may be disposed into the cartridge body sidewall, and a third radial oil passage (224) which may be disposed into the ball plunger sidewall.

Included in FIG. 5 is an exploded cross section view of an embodiment of a self-contained hydraulic cartridge (200). In the embodiment shown in FIG. 5, the cartridge body (210) may comprise a high pressure chamber (212) located within a bore (218) originating from the cartridge body first end (211). The cartridge body may also comprise a second radial oil passage (214) disposed into a cartridge body sidewall. As described above, in some embodiments, engine oil which has passed through the first radial oil passage (120) may then pass through the second radial oil passage to eventually enter the low pressure chamber (222) through the third radial oil passage (224) in the ball plunger sidewall. In some embodiments, the cartridge body may further comprise a circumferential recess (216) in the cartridge body sidewall which allows the engine oil to flow around the cartridge body after entering the hydraulic cartridge bore (110) through the first radial oil passage.

FIG. 5 also shows a ball plunger (220) of one embodiment of a self-contained hydraulic cartridge. As shown in FIG. 5, the ball plunger may comprise a low pressure chamber (222) located within a bore originating from the ball plunger second end. The ball plunger may also have a first convex surface (228) at the ball plunger first end which is opposite of the ball plunger second end. In some embodiments, the ball plunger may comprise a third radial oil passage (224) disposed into a ball plunger sidewall. As described above, when the third radial oil passage is present, engine oil which has passed through the first radial oil passage (120) and the second radial oil passage (214) may then pass through the third radial oil passage to enter the low pressure chamber.

FIG. 5 also shows a lifter piston (230) of one embodiment of a self-contained hydraulic cartridge. When assembled, the lifter piston may separate the high pressure chamber (212) from the low pressure chamber (222). The high pressure chamber and the low pressure chamber may be further separated by a check valve (240). Also shown in FIG. 5 is a relief bore (242) which is an area in the inner sidewall of the cartridge body having a greater inside diameter and is used to allow precision boring of the remaining inside diameter of the cartridge body. When assembled, the check valve may be disposed between the lifter piston and the high pressure chamber. Also shown in FIG. 5 is a plunger spring (250). When assembled, the plunger spring may be located within the high pressure chamber and may abut against the retainer.

Figure 6:
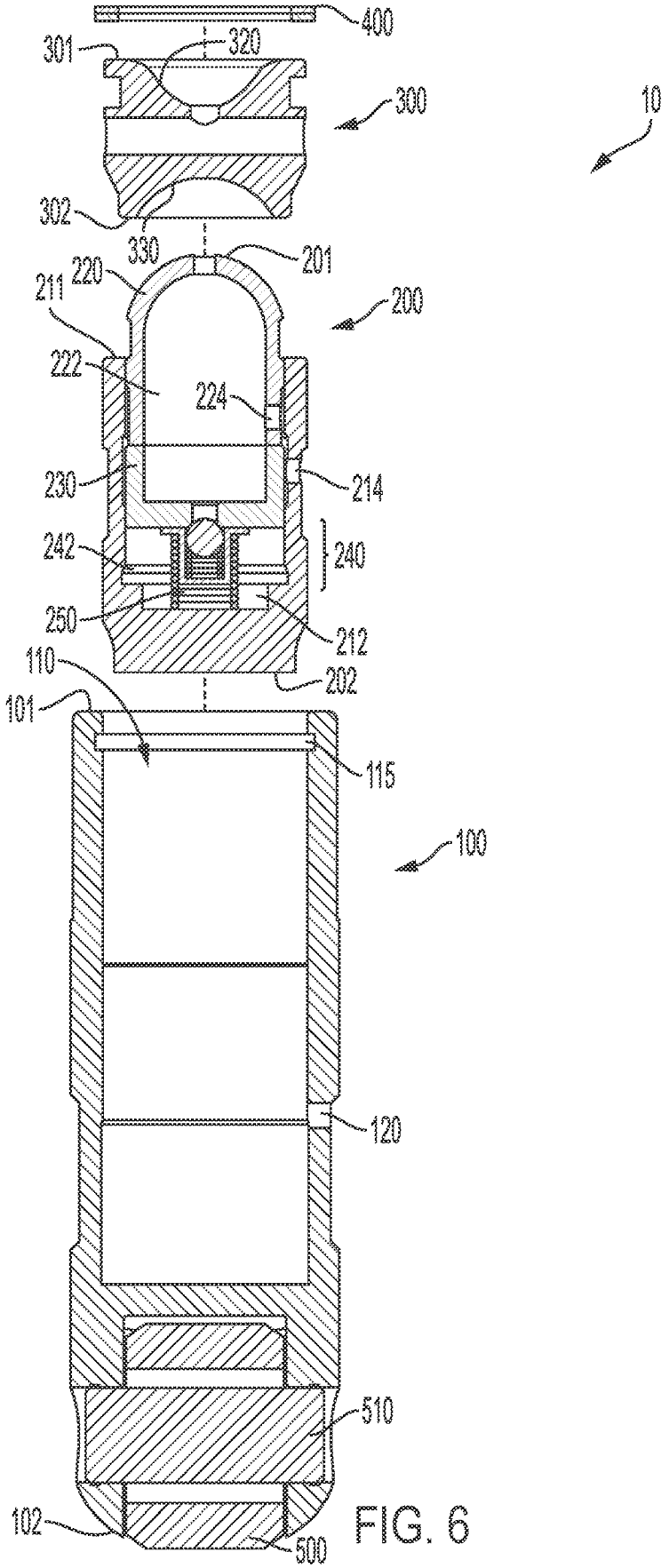
FIG. 6 is a partially exploded perspective view of one embodiment of an invented hydraulic lifter.

FIG. 6 shows a partially exploded cross section view of the embodiment of an invented hydraulic lifter (10) shown in FIG. 5. In FIG. 6, the various components of an embodiment of the self-contained hydraulic cartridge (200) have been assembled. As shown in FIG. 6, the ball plunger (220) may be disposed within the bore (218) originating from the cartridge body first end (211) with a portion of the ball plunger extending from the cartridge body first end. The lifter piston (230), check valve (240), and plunger spring (250) may be assembled to separate the high pressure chamber (212) of the cartridge body (210) from the low pressure chamber (222) of the ball plunger.

Figure 7:
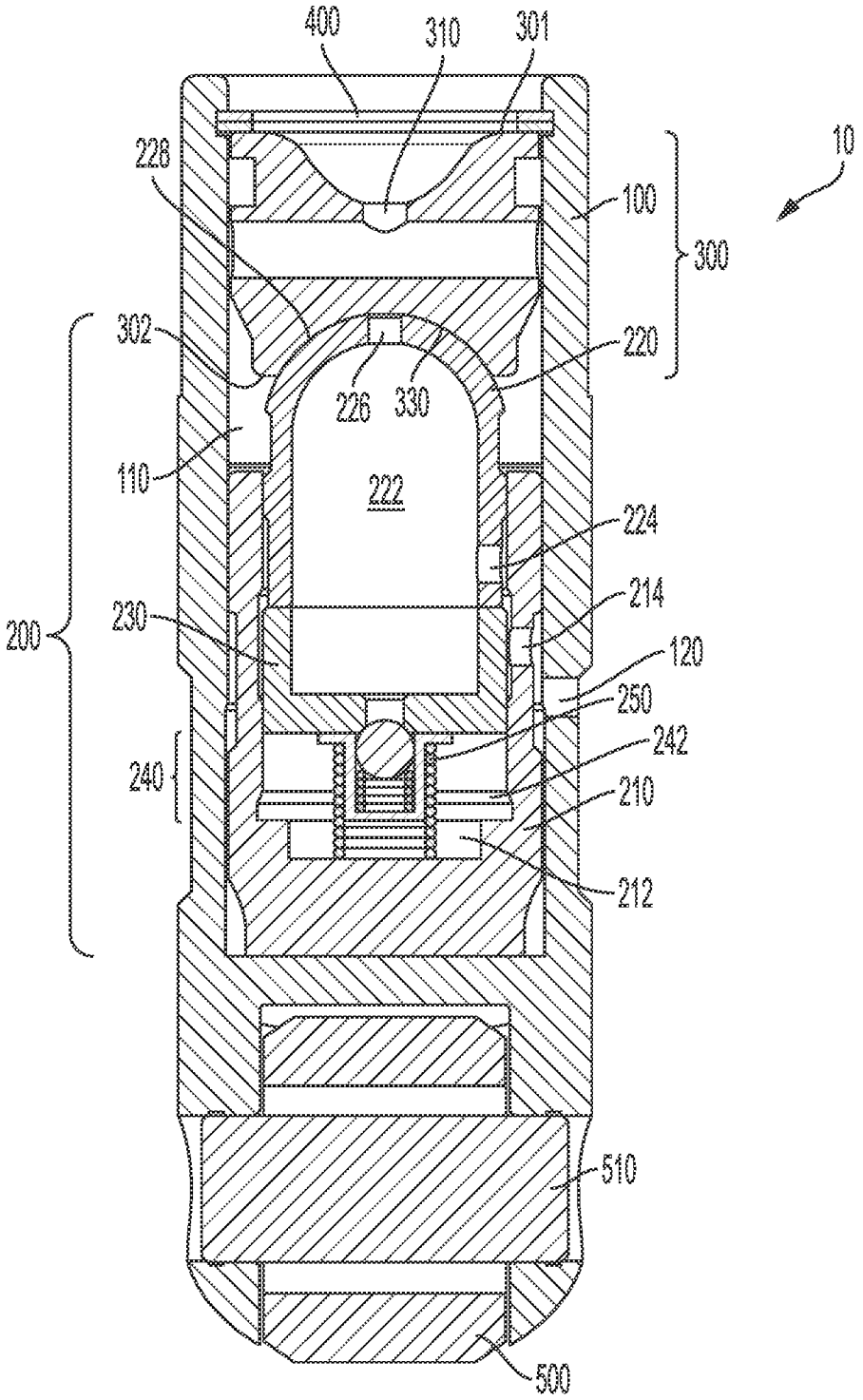
FIG. 7 is a fully assembled cross section view of one embodiment of an invented hydraulic lifter.

FIG. 7 depicts a fully assembled cross section view of an embodiment of an invented hydraulic lifter (10) for an internal combustion engine. As shown in FIG. 7, the hydraulic lifter may comprise a lifter body (100), a hydraulic cartridge (200), a pushrod seat (300), and a retaining clip (400).

As shown in FIG. 7, when assembled, the hydraulic cartridge (200) may be located within the hydraulic cartridge bore (110) in the lifter body (100). The lifter body may also comprise a first radial oil passage (120) disposed in a lifter body sidewall. This first radial oil passage allows engine oil to flow through the lifter body into the hydraulic cartridge through a series of additional oil passages as described herein.

The hydraulic cartridge (200) may be a self-contained hydraulic system. In other words, the hydraulic system does not utilize a surface of the lifter body or the bore in the lifter body to form any part of the high pressure chamber or the low pressure chamber. In practice, this means that the lifter piston in the invented hydraulic lifter is not disposed within a bore formed in an internal cavity of the lifter bore. One example of a self-contained hydraulic cartridge is known as a Hydraulic Lash Adjuster (HLA) and is commonly used in Over Head Cam (OHC) valve trains.

The embodiment of a hydraulic cartridge (200) shown in the Figures may comprise a cartridge body (210), a ball plunger (220), a lifter piston (230), a check valve (240), and a plunger spring (250). The cartridge body may be in the form of a longitudinal cylinder having a first end comprising an opening to a cavity (or bore) within the cartridge body and a second end which is a sealed end. At the second end of the cartridge body may be a high pressure chamber (212), which is a void in the cartridge body into which oil or other hydraulic fluid flows as the lifter comes out of the lift phase. The cartridge body will also comprise a second radial oil passage (214) disposed into the cartridge body sidewall. The second radial oil passage should not be located in a position on the cartridge body sidewall which corresponds to the location of the high pressure chamber. This second radial oil passage allows engine oil which has passed through the first radial oil passage (120) to flow through the cartridge body and into the low pressure chamber (222) through a series of additional oil passages as described herein.

The ball plunger (220) may be in the form of a longitudinal cylinder having a first convex surface (228) located at a ball plunger first end (221) and a ball plunger second end (223) opposite the ball plunger first end having an opening to a cavity (or bore) within the ball plunger. The ball plunger will be partially contained within the cartridge body with the second end of the ball plunger passing into the opening at the first end of the cartridge body.

The cavity (or bore) within the ball plunger (220) forms at least a portion of a low pressure chamber (222). Disposed into a sidewall of the ball plunger is a third radial oil passage (224) The third radial oil passage allows engine oil which has passed through the first radial oil passage and the second radial oil passage to flow into the low pressure chamber of the ball plunger.

The lifter piston (230) is disposed within the cavity of the cartridge body (210) and abuts against the second end of the ball plunger (220). The lifter piston also serves to separate the high pressure chamber (212) from the low pressure chamber (222). The high pressure chamber and the low pressure chamber may be further separated by the check valve (240) which may be an integral component of the lifter piston or may be formed separately from the lifter piston.

In practice, any type of check valve known in the art may be utilized. Preferred examples of check valves include ball check valves and disc check valves. In the ball check valve, a sphere (or ball) rests against a hole in the lifter piston. The ball may be forced against the hole in the lifter piston by way of a check valve spring. When pressure within the low pressure chamber exceeds the force of the check valve spring, the ball advances away from (or unseats from) the hole in the lifter piston, allowing engine oil to flow out of the low pressure chamber and into the high pressure chamber. The disc check valve may be of a similar design, only replacing the sphere (ball) with a cylindrical disc.

The pushrod seat (300) may be contained within the hydraulic cartridge bore (110) with a second concave surface (330) at the pushrod seat second end (302) abutting against a first convex surface (228) at the first end of the ball plunger. The pushrod seat first end (301) may then abut against the retaining clip (400) which is located within a groove disposed in the hydraulic cartridge bore. The retaining clip prevents the various internal components (hydraulic cartridge and pushrod seat) from exiting the hydraulic cartridge bore.

In some embodiments, the ball plunger (220) may comprise a first axial oil passage (226) passing through the first end of the ball plunger. As used herein and in the claims, the term "axial oil passage" refers to a hole passing through a sidewall of a substantially cylindrical component of the lifter in an axial direction. While a central axis of the axial oil passage may be substantially parallel with or parallel with the central axis of the substantially cylindrical component, it is not required that the central axis of the hole be parallel with the central axis of the substantially cylindrical component. In some embodiments, a central axis of the axial oil passage may form an angle with the central axis of the substantially cylindrical component which is in a range selected from the group consisting of between 0° and 89°, between 0° and 60°, between 0° and 30°, between 0° and 20°, between 0° and 10°, and between 0° and 5°. While embodiments may exist in which the axial oil passage and the substantially cylindrical component share a central axis, other embodiments may exist in which the central axis of the axial oil passage is offset from the central axis of the substantially cylindrical component.

The first axial oil passage (226) allows engine oil from within the low pressure chamber (222) to exit the hydraulic cartridge and pass to the pushrod seat (300) where it may be further passed through the pushrod seat to provide lubrication to the end of the pushrod. In some embodiments, the pushrod seat may also comprise a second axial oil passage (310) through which the engine oil passes to provide lubrication to the end of the pushrod.

Figure 8:
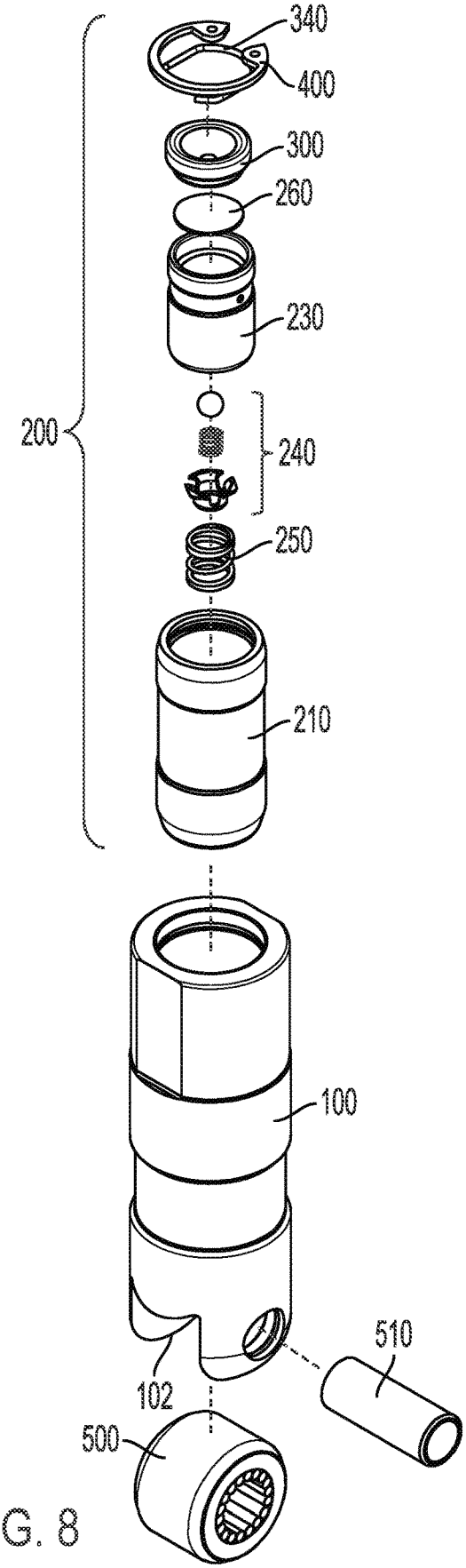
FIG. 8 is a fully exploded perspective view of one embodiment of an invented hydraulic lifter.
Figure 9:
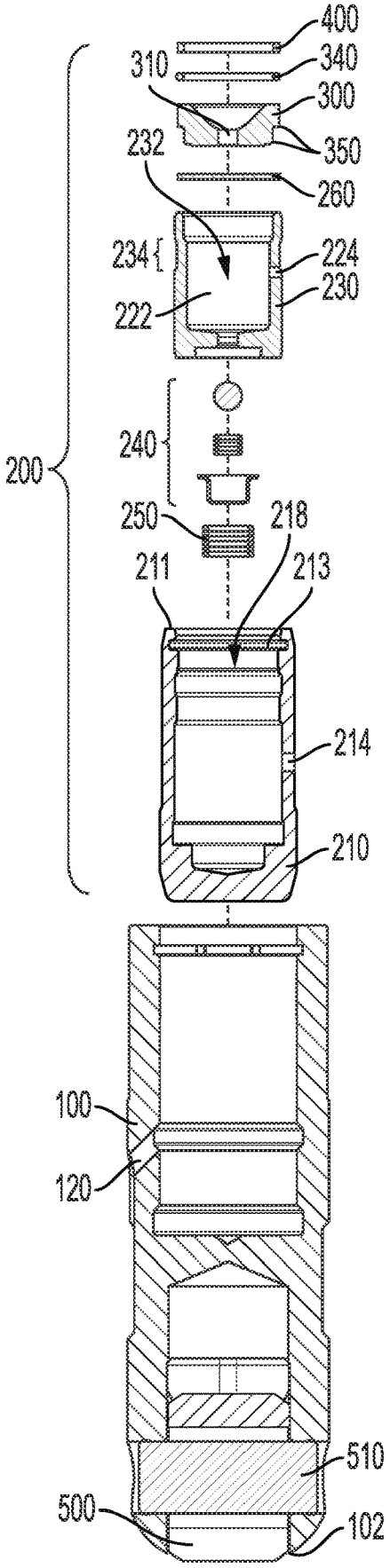
FIG. 9 is a fully exploded cross section view of one embodiment of an invented hydraulic lifter.
Figure 10:
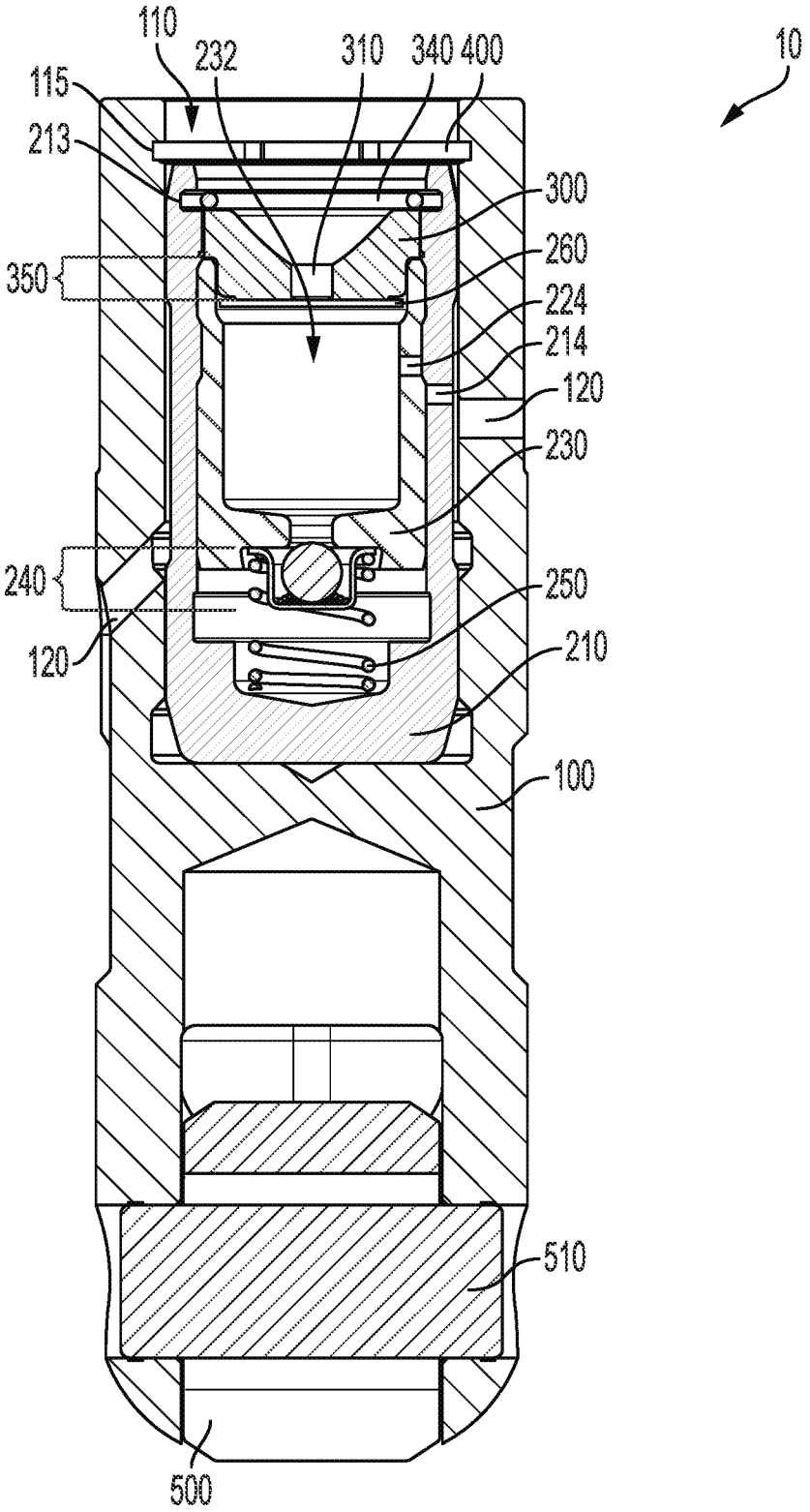
FIG. 10 is a fully assembled cross section view of one embodiment of an invented hydraulic lifter.

FIG. 8 through FIG. 10 shows an alternative embodiment in which the pushrod seat (300) is integrated into the self-contained hydraulic cartridge (200). As shown in FIG. 8, which is an exploded perspective view of the alternative embodiment, this embodiment includes similar components to that of the embodiment shown in FIG. 3 through FIG. 7. Specifically, this embodiment includes a lifter body (100), a self-contained hydraulic cartridge (200), a pushrod seat (300), and a retaining clip (400). As shown in FIG. 8, this embodiment may also include an optional roller (500), although this embodiment may also be in the form of a flat tappet hydraulic lifter (i.e.—not comprising a roller) as described herein.

In the embodiment shown in FIG. 8, the self-contained hydraulic cartridge (200) comprises the cartridge body (210), a piston (230), a check valve (240), and a plunger spring (250). However, unlike the embodiment shown in FIG. 3 through FIG. 7, in the embodiment shown in FIG. 8 the self-contained hydraulic cartridge also comprises the pushrod seat (300) and a pushrod seat clip (340).

FIG. 9 shows an exploded cross-section view of the alternative embodiment of a hydraulic lifter shown in FIG. 8. As shown in FIG. 9, the lifter body (100), check valve (240), and plunger spring (250) may be of similar or identical design to the lifter body, check valve, and plunger spring shown in FIG. 3 through FIG. 7 and described herein.

As also shown in FIG. 9, the cartridge body (210) may be of similar design to the cartridge body shown in FIG. 3 through FIG. 7 and described herein. The notable difference between the cartridge body shown in the embodiment in FIG. 8 through 10 compared to the cartridge body shown in the embodiment in FIG. 3 through FIG. 7 is that the cartridge body shown in FIG. 8 through FIG. 10 comprises a circumferential groove (213) disposed in the bore (218) of the cartridge body proximate to the cartridge body first end (211). It is within this groove that the pushrod seat clip (340) is located when the self-contained hydraulic cartridge is assembled as shown in FIG. 10.

FIG. 9 also shows additional details of the lifter piston (230). As shown in FIG. 9, the lifter piston may comprise an axial hole (232). Once assembled as shown in FIG. 10, this axial hole forms a portion of the low pressure chamber (222). The sidewall of the lifter piston may also comprise a third radial oil passage (224) which allows oil from external to the hydraulic lifter that has passed through the first radial oil passage (120) and the second radial oil passage (214) to enter the low pressure chamber. In some embodiments, the lifter piston may also comprise a piston circumferential recess (234) which forms a channel to allow the oil to flow around the lifter piston and reach the third radial oil passage.

FIG. 9 also shows the pushrod seat (300) of the alternative embodiment. As shown in FIG. 9, the pushrod seat may be of similar design to the pushrod seat shown in FIG. 3 through FIG. 7. However, in certain embodiment the pushrod seat will not comprise a second concave surface. In some embodiments, the pushrod seat will comprise a seat circumferential recess (350).

FIG. 10 shows the assembled cross section view of the hydraulic lifter embodiment shown in FIG. 8 and FIG. 9. As shown, once assembled the sidewalls of the lifter piston (230) interact with the seat circumferential recess (350) to locate the pushrod seat (300) within a portion of the axial hole (232). Once the pushrod seat has been located, the pushrod seat clip (340) is disposed within the circumferential groove (213) to maintain the pushrod seat, the lifter piston (230), the check valve (240), and the plunger spring (250) within the bore (218 as shown in FIG. 9) of the cartridge body (210). The self-contained hydraulic cartridge (200) is then inserted into the hydraulic cartridge bore (110) of the lifter body (100) and held in place by the retaining clip (400) which interacts with the groove (115).

The embodiment shown in FIG. 8 through FIG. 10 may also include an optional metering disk (260). When present, the metering disk may be located within the axial hole (232) beneath the pushrod seat (300) as shown in FIG. 10. The metering disk may be sized and shaped to regulate the amount and pressure of oil flowing through the first axial oil passage (310) in the pushrod seat—which also maintains the hydraulic pressure of the self-contained hydraulic cartridge. By changing the size and shape of the metering disk, the amount of oil which can flow through to the first axial oil passage in the pushrod seat will change, and will increase or decrease the hydraulic pressure of the self-contained hydraulic cartridge. For example, a metering disk having a diameter of 2.0 cm will allow less oil to flow through to the first axial oil passage and will therefore result in increased hydraulic pressure of the self-contained hydraulic cartridge than a metering disk having a diameter smaller than 2.0 cm.

In certain embodiments, the metering disk (260) may include one or more slots, grooves, and/or holes passing through the metering disk plane. The slots, grooves, and/or holes may be located at or within the perimeter of the metering disk. In addition to, or instead of slots, grooves, and/or holes, the metering disk may comprise one or more bends along a plane parallel to the metering disk diameter. When present, the slots, grooves, holes, and/or bends may change the amount, velocity, and/or directionality of oil flowing from the low pressure chamber (222) through the first axial oil passage (310) of the pushrod seat (300) and to the pushrod (620 as shown in FIG. 12).

The hydraulic lifter may be of a roller lifter variety or a flat tappet variety. In roller lifter embodiments (shown in FIG. 3 to FIG. 10), the hydraulic lifter may further comprise a roller (500) connected to the lifter body at a lifter body second end (102) which is opposite of a lifter body first end at which the pushrod seat is located. The roller may be connected to the lifter body by an axle (510). When used, the roller contacts the corresponding lobe of the camshaft, and reduces the friction between the camshaft lobe and the lifter during operation. In flat tappet embodiments, the hydraulic lifter does not comprise a roller connected to the lifter body second end which is opposite of the lifter body first end at which the pushrod seat is located.

Figure 11:
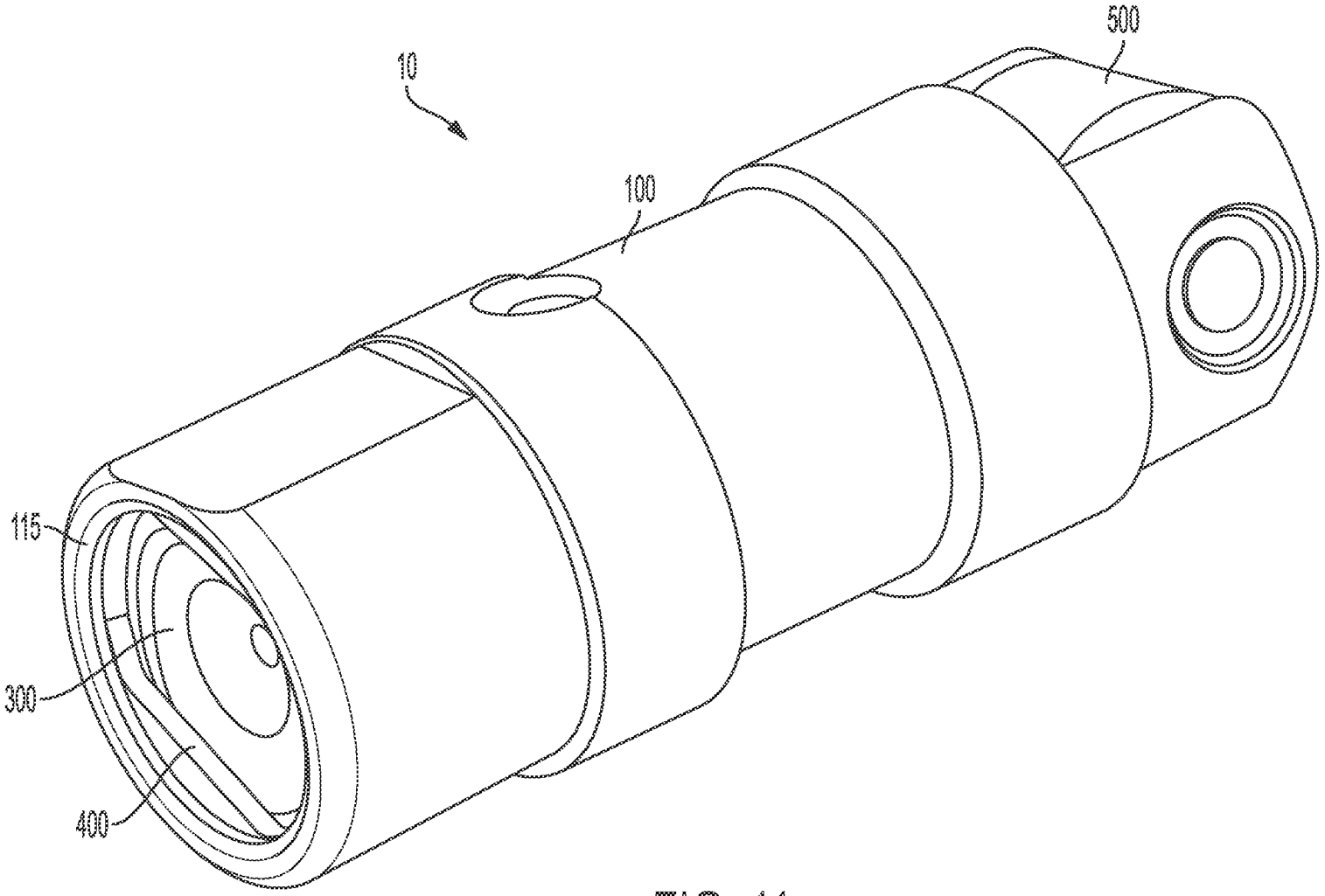
FIG. 11 is a fully assembled perspective view of one embodiment of an invented hydraulic lifter.

FIG. 11 shows a fully assembled perspective view of the embodiment of an invented hydraulic lifter (10) shown in FIG. 3 through FIG. 7 or FIG. 8 through FIG. 10. As shown in FIG. 11, the retaining clip (400) is disposed within the groove (115) in the hydraulic cartridge bore. The pushrod seat (300) is disposed within the hydraulic cartridge bore with the pushrod seat first end abutting against the retaining clip. Not shown in FIG. 11, but located beneath the pushrod seat as shown in the embodiments in FIG. 3 through FIG. 7, may be the self-contained hydraulic cartridge with the first convex surface of the self-contained hydraulic cartridge abutting against the second concave surface at the pushrod seat second end.

Figure 12:
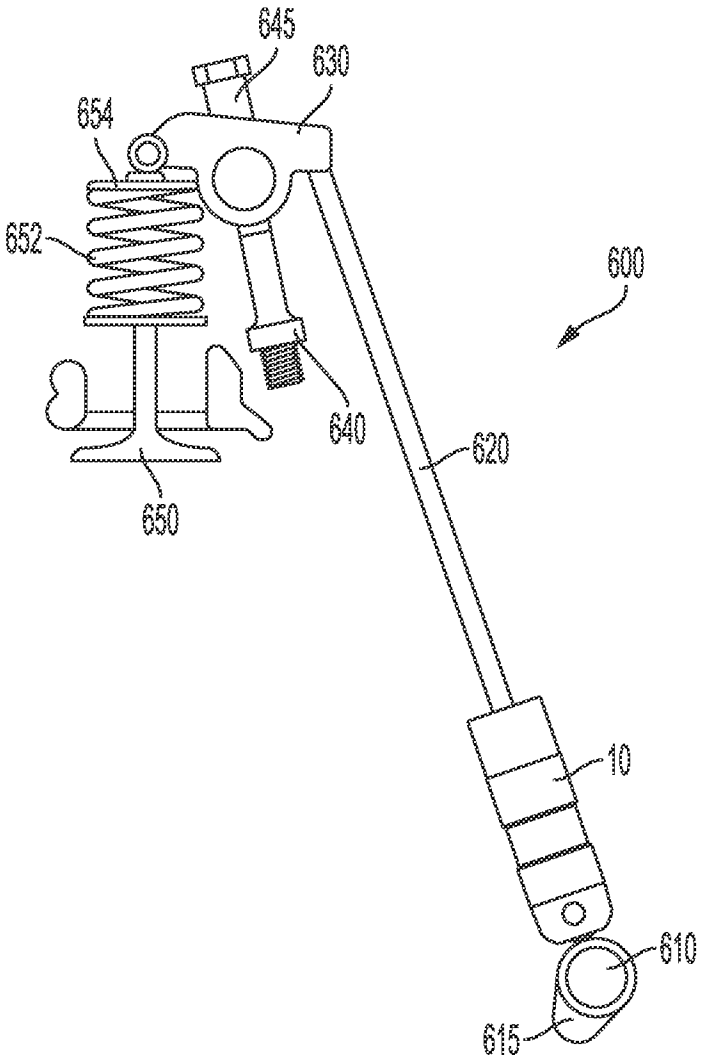
FIG. 12 is a side view of an assembled version of a valvetrain for an internal combustion engine.

FIG. 12 shows an assembled version of a valvetrain (600) for an internal combustion engine with an embodiment of the invented hydraulic lifter (10) installed. As shown in FIG. 12, the valvetrain may comprise at least one camshaft (610), at least one pushrod (620), at least one rocker arm (630), at least one rocker arm mounting stud (640), at least one valve (650), at least one valve spring (652), and at least one valve spring retainer (654).

When assembled, the hydraulic lifter (10) may be disposed within a lifter bore in the engine block with the lifter body second end (102) or the roller (500) in contact with a camshaft lobe (615) of the camshaft (610). As the camshaft rotates, the camshaft lobe advances and retracts the hydraulic lifter through the lifter bore in the engine block. The pushrod (620) is disposed between the hydraulic lifter and the rocker arm (630) with one end of the pushrod in contact with the pushrod seat (300) and the opposite end of the pushrod in contact with a corresponding pushrod seat at one end of the rocker arm. The rocker arm may be connected to the engine's cylinder head by passing the rocker arm mounting stud (640) through a hole in the rocker arm and securing the rocker arm with a rocker arm mounting nut (645). Alternatively, the rocker arm may be a shaft mounted rocker arm as described herein. The end of the rocker arm opposite the end having the pushrod seat may rest against a tip of the valve (650) with the valve stem being disposed through a hole in the cylinder head. The valve spring (652) is disposed around the stem of the valve and is connected to the valve by the valve spring retainer (654) and a corresponding valve lock (not shown) which is disposed within a groove in the tip of the valve. Another type of rocker arm is a pedestal mounted rocker arm and is typically found in General Motors LS1 platform engines.

As the hydraulic lifter (10) advances due to the rotation of the camshaft (610), the hydraulic lifter forces the pushrod to advance and retract. This motion causes the rocker arm (630) to pivot with the rocker arm mounting stud (or the shaft in a shaft mounted rocker arm) serving as the pivot point. As the rocker arm pivots, it advances the valve (650) into the cylinder head—also known as opening the valve. As the hydraulic lifter retracts due to the rotation of the camshaft, the process reverses itself ending with the valve spring (652) applying a force to retract the valve—also known as closing the valve.

While the embodiments shown in FIG. 12 include a rocker arm mounting stud (640) for connecting the rocker arm to the cylinder head, other connection mechanisms may exist. One such connection mechanism is known as a shaft mounted rocker arm in which one or more rocker arms pivots along a shaft with the shaft being connected to the cylinder head.

While FIG. 12 shows the assembled version of a valvetrain (600) with only a single valve, one of ordinary skill will understand that in most applications the valvetrain will comprise multiple valves. The typical valvetrain configuration will include at least two valves per engine cylinder with one of the two valves serving as an intake valve and the other valve serving as an exhaust valve. Typically, each valve will have its own separate hydraulic lifter, pushrod, rocker arm, rocker arm mounting stud (when used), valve spring, and valve spring retainer. For example, a standard in-line four cylinder engine may have eight valves (four intake valves and four exhaust valves) with each valve having its own corresponding hydraulic lifter, pushrod, rocker arm, rocker arm mounting stud, valve spring, and valve spring retainer.

In some embodiments, the valvetrain may have more than two valves per engine cylinder. For example, in certain embodiments, the valvetrain may have two or more intake valves per engine cylinder and/or two or more exhaust valves per engine cylinder with each individual intake valve and each individual exhaust valve having its own separate hydraulic lifter, pushrod, rocker arm, rocker arm mounting stud (when used), valve spring, and valve spring retainer.

The various components described herein may be manufactured using a variety of commonly known techniques including—but not limited to—forging, CNC machining, and additive manufacturing.

By removing the lifter piston from the bore in the lifter body and placing the entire hydraulic system into a self-contained hydraulic cartridge, the current invention overcomes many of the challenges faced by prior art hydraulic lifters. For example, the invented hydraulic lifters are not sensitive to lifter body distortion, and will maintain a consistent hydraulic pressure and bleed down rate regardless of minor distortions to the lifter body. Additionally, the hydraulic cartridge can be easily replaced "in the field" by simply removing the retaining clip, removing the pushrod seat from the hydraulic cartridge bore, removing the hydraulic cartridge from the hydraulic cartridge bore, replacing the hydraulic cartridge with a new hydraulic cartridge, and reassembling the pushrod seat and retaining clip.

What is claimed is:

1. A hydraulic lifter (10) for an internal combustion engine, the hydraulic lifter comprising:

a lifter body (100) comprising a hydraulic cartridge bore (110), and a first radial oil passage (120) disposed through a lifter body sidewall;

a self-contained hydraulic cartridge (200);

a pushrod seat (300); and a retaining clip (400); and wherein the self-contained hydraulic cartridge and the pushrod seat are contained within the hydraulic cartridge bore; a pushrod seat second end (302) abuts against a self-contained hydraulic cartridge first end (201); the retaining clip is located within a groove (115) disposed in a sidewall of the hydraulic cartridge bore at a lifter body first end (101); and a pushrod seat first end (301) which is opposite of the pushrod seat second end abuts against the retaining clip.

2. The hydraulic lifter of claim 1, further comprising a roller (500) connected to the lifter body at a lifter body second end (102) which is opposite of the lifter body first end.

3. The hydraulic lifter of claim 2, wherein the roller is connected to the lifter body by an axle (510).

4. The hydraulic lifter of claim 2, wherein the self-contained hydraulic cartridge comprises:

a cartridge body (210) comprising a high pressure chamber (212), a second bore (218) originating from a cartridge body first end (211), a cartridge body sidewall, a second radial oil passage (214) formed in the cartridge body sidewall, and a circumferential groove (213) formed in the second bore proximate to the cartridge body first end;

a lifter piston (230) comprising an axial hole (232) forming a portion of a low pressure chamber (222), and a third radial oil passage (224) to the low pressure chamber formed in a lifter piston sidewall, wherein the lifter piston is disposed within the second bore;

a check valve (240), said check valve disposed between the lifter piston and the high pressure chamber; and a plunger spring (250) within the high pressure chamber; and wherein the pushrod seat is located within a portion of the axial hole, with a portion of a pushrod seat first end (301) abutting against a pushrod seat clip (340) disposed within the circumferential groove.

5. The hydraulic lifter of claim 4, wherein the lifter piston further comprises a piston circumferential recess (234).

6. The hydraulic lifter of claim 4, wherein the pushrod seat comprises a seat circumferential recess (350), and a sidewall of the lifter piston (230) interacts with the circumferential recess of the pushrod seat.

7. The hydraulic lifter of claim 4, further comprising a metering disk (260) located within the axial hole beneath the pushrod seat.

8. The hydraulic lifter of claim 1, wherein the hydraulic lifter does not comprise a roller connected to the lifter body at a lifter body second end which is opposite of a lifter body first end.

9. The hydraulic lifter of claim 1, wherein the pushrod seat comprises a first axial oil passage (310).

10. The hydraulic lifter of claim 1, wherein the self-contained hydraulic cartridge comprises:

a cartridge body (210) comprising a high pressure chamber (212), a second bore (218) originating from a cartridge body first end (211), a cartridge body sidewall having a circumferential recess (216), and a second radial oil passage (214) formed in the cartridge body sidewall;

a ball plunger (220) comprising a low pressure chamber (222), and a third radial oil passage (224) to the low pressure chamber formed in a ball plunger sidewall, wherein the ball plunger is disposed within the second bore, and wherein a portion of the ball plunger extends from the cartridge body first end;

a lifter piston (230) separating the high pressure chamber from the low pressure chamber;

a check valve (240), said check valve disposed between the lifter piston and the high pressure chamber; and a plunger spring (250) within the high pressure chamber.

11. The hydraulic lifter of claim 10, wherein the ball plunger comprises a second axial oil passage (226).

12. The hydraulic lifter of claim 10, wherein the check valve is a ball check valve.

13. The hydraulic lifter of claim 10, wherein the check valve is a disc check valve.

14. The hydraulic lifter of claim 10, wherein the check valve comprises a check valve spring.

15. The hydraulic lifter of claim 1, wherein the self-contained hydraulic cartridge comprises:

a cartridge body (210) comprising a high pressure chamber (212), a second bore (218) originating from a cartridge body first end (211), a cartridge body sidewall, a second radial oil passage (214) formed in the cartridge body sidewall, and a circumferential groove (213) formed in the second bore proximate to the cartridge body first end;

a lifter piston (230) comprising an axial hole (232) forming a portion of a low pressure chamber (222), and a third radial oil passage (224) to the low pressure chamber formed in a lifter piston sidewall, wherein the lifter piston is disposed within the second bore;

a check valve (240), said check valve disposed between the lifter piston and the high pressure chamber; and a plunger spring (250) within the high pressure chamber; and wherein the pushrod seat is located within a portion of the axial hole, with a portion of a pushrod seat first end (301) abutting against a pushrod seat clip (340) disposed within the circumferential groove.

16. The hydraulic lifter of claim 15, wherein the lifter piston further comprises a piston circumferential recess (234).

17. The hydraulic lifter of claim 15, wherein the pushrod seat comprises a seat circumferential recess (350), and a sidewall of the lifter piston (230) interacts with the circumferential recess of the pushrod seat.

18. The hydraulic lifter of claim 15, further comprising a metering disk (260) located within the axial hole beneath the pushrod seat.

19. The hydraulic lifter of claim 15, wherein the check valve is a ball check valve.

20. The hydraulic lifter of claim 15, wherein the check valve is a disc check valve.

* * * * *